US011718099B2

(12) United States Patent
Osakabe et al.

(10) Patent No.: US 11,718,099 B2
(45) Date of Patent: Aug. 8, 2023

(54) INK TANK AND IMAGE RECORDING APPARATUS

(71) Applicant: BROTHER KOGYO KABUSHIKI KAISHA, Nagoya (JP)

(72) Inventors: Yoshinori Osakabe, Seto (JP); Taichi Shirono, Nagoya (JP); Takashi Kitagawa, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/480,333

(22) Filed: Sep. 21, 2021

(65) Prior Publication Data

US 2022/0097392 A1 Mar. 31, 2022

(30) Foreign Application Priority Data

Sep. 30, 2020 (JP) ..... 2020-166292

(51) Int. Cl.
*B41J 2/175* (2006.01)

(52) U.S. Cl.
CPC ..... *B41J 2/17509* (2013.01); *B41J 2/1754* (2013.01); *B41J 2/17533* (2013.01); *B41J 2/17546* (2013.01); *B41J 2/17596* (2013.01)

(58) Field of Classification Search
CPC ..... B41J 2/17503; B41J 2/17506; B41J 2/17509; B41J 2/17513; B41J 2/17533; B41J 2/1754; B41J 2/17546; B41J 2/17553; B41J 2/17566; B41J 2/17596; B41J 2002/17573; B41J 29/02; B41J 29/13

See application file for complete search history.

(56) References Cited

U.S. PATENT DOCUMENTS 5,289,211 A * 2/1994 Morandotti ..... B41J 2/17566 73/304 R
5,997,121 A * 12/1999 Altfather ..... B41J 2/17566 347/7
6,394,590 B1 * 5/2002 Koitabashi ..... B41J 2/17506 347/86
6,520,630 B1 * 2/2003 Oda ..... B41J 2/17523 347/85
6,866,372 B2 * 3/2005 Oda ..... B41J 2/17503 347/85

(Continued)

FOREIGN PATENT DOCUMENTS

WO 2019/078898 A1 4/2019

*Primary Examiner* — Anh T Vo
(74) *Attorney, Agent, or Firm* — Merchant & Gould P.C.

(57) ABSTRACT

An ink tank includes: a first liquid storage chamber; a second liquid storage chamber; a detector having at least two electrode rods in the first liquid storage chamber; an injector having an opening supplying liquid to the first liquid storage chamber; an atmospheric communication passage communicating an outside of the ink tank with the second liquid storage chamber; a cap movable between an open position and a closed position with respect to the injector and configured to seal the first liquid storage chamber; a valve mechanism opening or closing the communication passage by moving up and down with respect to the communication passage; a link mechanism moving the valve mechanism up and down; and a guide portion guiding the valve mechanism, at least a part of the guide portion being provided in the valve mechanism.

7 Claims, 10 Drawing Sheets

(56) References Cited

U.S. PATENT DOCUMENTS

| | | | | |
|---|---|---|---|---|
| 7,690,772 | B2 * | 4/2010 | Scardovi | B41J 2/1652 347/85 |
| 8,454,139 | B2 * | 6/2013 | Ishizawa | B41J 2/17553 347/85 |
| 2016/0263905 | A1 * | 9/2016 | Kimura | B41J 2/17553 |
| 2020/0238742 | A1 * | 7/2020 | Cantrell | B41J 1/00 |

* cited by examiner

INK TANK AND IMAGE RECORDING APPARATUS

CROSS-REFERENCE TO RELATED APPLICATIONS

This application is based on and claims priority under 35 USC 119 from Japanese Patent Application No. 2020-166292 filed on Sep. 30, 2020, the contents of which are incorporated herein by reference.

TECHNICAL FIELD

The present disclosure relates to an ink tank storing ink and an image recording apparatus including the ink tank.

BACKGROUND

In a recent year, there is an image recording apparatus having an ink tank capable of filling and refilling ink. FIG. 1A illustrates an example of an image recording apparatus 300. As illustrated in FIG. 1A, the image recording apparatus 300, which is an example of the inkjet recording apparatus, has a substantially rectangular parallelepiped shape. The image recording apparatus 300 includes a scanner above the image recording apparatus 300, which reads an image recorded on a document such as paper by an image sensor (not illustrated) and acquires image data. Further, a printer for recording an image on a sheet is provided in a lower part of the image recording apparatus 300. The printer includes an inkjet recording type recording head 310 as an example of a liquid consumption device.

In the following description, an up-down direction is defined with reference to a posture (the posture illustrated in FIGS. 1A and 1B and it may be referred to as "usage posture".) in which an ink tank mounted on the image recording apparatus 300 is installed in a horizontal plane for use. Further, a front-rear direction is defined with a side on which an opening and closing cover 307 is provided as a front side and a left-right direction is defined when the image recording apparatus 300 is viewed from the front side. In the illustrative embodiment, in the usage posture, the up-down direction corresponds to a vertical direction and the front-rear direction and the left-right direction correspond to a horizontal direction.

In the image recording apparatus 300 of FIG. 1A, the opening and closing cover 307 which can be opened or closed is in an open position. In the image recording apparatus 300, three ink tanks 303 in which three colors of CMY (Cyan, Magenta, Yellow) ink are stored are arranged on a front left side of the device. Of these three ink tanks 303, a cap 304 of the leftmost ink tank 303 is in an open position and caps 304 of the other two ink tanks 303 are in a closed position. On the other hand, an ink tank 303 containing BK (Black) ink is arranged on a front right side of the image recording apparatus 300. A cap 304 of the ink tank 303 for BK is in the closed position. When the opening and closing cover 307 is in the open position, a user can access these ink tanks 303, that is, supply or replenish ink. FIG. 1B is an enlarged view of a front portion 302 of the three ink tanks 303 arranged on the front left side.

A schematic structure of the ink tank 303 mounted on the image recording apparatus 300 will be described below with reference to FIGS. 2 to 7C.

FIG. 2 is a side view of the ink tank 303 as viewed from a left side. Since a transparent film 110 is welded to a left side surface of the ink tank 303, an internal structure of the ink tank 303 can be visually recognized.

FIG. 3 is a right side view of the ink tank 303 of the related art with the cap 304 in a closed position. However, positions of two electrode rods 331A and 331B and a first guide rib 332 of a sensor are emphasized so that an arrangement thereof, which cannot be seen from a right side surface, can be understood.

FIG. 4 is a perspective view illustrating only a link mechanism 200 used in the ink tank 303.

FIG. 5A is a schematic view illustrating the ink tank 303 in a state where a valve is sealed by the cap 304 in an open position and FIG. 5B is a schematic view illustrating the ink tank 303 in a state where the valve is opened by the cap 304 in a closed position. However, FIGS. 5A and 5B do not illustrate a second ink chamber 401 provided below the first ink chamber 301.

FIGS. 6A and 6B are views illustrating a schematic structure of a valve body 207 and a seal member 209 of the related art, where FIG. 6A illustrates a schematic plan view of the valve body 207 and the seal member 209 of the related art and a schematic cross-sectional view cut along the VIA-VIA line and FIG. 6B illustrates a schematic side view of the valve body 207 and the seal member 209 of the related art and a schematic cross-sectional view cut along the VIB-VIB line.

FIGS. 7A to 7C are schematic views illustrating an operation of the valve main body 207 and the seal member 209 of the related art opening or closing a communication passage 220 and a schematic view illustrating an arrangement of various members around the communication passage 220, where FIG. 7A illustrates a state in which the valve body 207 and the seal member 209 of the related art illustrated in FIG. 6A close the communication passage 220, FIG. 7B illustrates a state in which the valve body 207 and the seal member 209 of the related art illustrated in FIG. 6A open the communication passage 220, and FIG. 7C illustrates a schematic view showing an arrangement of various members around the communication passage 220.

As illustrated in FIG. 2, in the ink tank 303, the cap 304 is rotatably attached to an ink tank body 306. The cap 304 is able to seal an injection cylinder 305. The cap 304 is always urged from the closed position to the open position by an elastic body (rubber O-ring as an example) (not illustrated). When an engagement that holds the cap 304 in the closed position is released, the cap 304 rotates by itself from the closed position in which the injection cylinder 305 is sealed to the open position. Further, the cap 304 includes a protrusion 201 which extends downward when in the closed position, as illustrated in FIG. 4. When the cap 304 is in the open position, the protrusion 201 is separated from a slider member 202 described below. However, when the cap 304 is in the closed position, the protrusion 201 presses the slider member 202 downward.

Next, the link mechanism 200 will be described with reference to FIG. 4. The link mechanism 200 is a mechanism for connecting the cap 304 and the valve body 207 in order to link an operation of the cap 304 with an operation of the valve body 207 described below.

The link mechanism 200 is composed of the slider member 202, a second lever arm 203, a first lever arm 206, a compression spring 204, a plurality of rubber O-rings, and the like.

The slider member 202, the second lever arm 203, and the compression spring 204 are arranged on the outside of the ink tank 303, that is, on a right wall of the ink tank 303. Further, a rotation shaft 205 of the first lever arm 206 penetrates a through hole 205A provided in the right wall forming the first ink chamber 301 from the inside of the first ink chamber 301 toward the outside of the ink tank 303. The through hole 205A is provided with an O-ring or the like (not illustrated) so that the ink in the first ink chamber 301 does not leak from the through hole 205A. Then, the first lever arm 206 can rotate in the first ink chamber 301 with the rotation shaft 205 as a center of rotation in conjunction with a rotation operation of the second lever arm 203 arranged on the right side wall of the ink tank 303.

The valve body 207 includes the seal member 209 which seals a communication passage 220 which communicates the first ink chamber 301 and the second ink chamber 401 and is rotatably coupled to the first lever arm 206. Then, the valve body 207 moves up and down as the slider member 202 moves, the second lever arm 203 rotates, and the first lever arm 206 rotates as the cap 304 opens or closes. As a result, the seal member 209 sits or separates from a valve seat 210 to open or close the communication passage 220 which communicates the first ink chamber 301 and the second ink chamber 401.

In addition, the ink tank 303 includes an ink outlet 360 for supplying ink to a recording head 310 and an atmospheric communication port 370 for communicating the inside of the second ink chamber 401 to the outside of the ink tank 303. The ink outlet 360 is provided in the second ink chamber 401. Although the atmospheric communication port 370 is provided at an upper portion of the ink tank 303, an atmospheric communication passage 371 for communicating the atmospheric communication port 370 with the inside of the second ink chamber 401 extends to the second ink chamber 401.

Further, the ink tank 303 is provided with a visual recognition portion 350 on a front side of the ink tank body 306. Since the ink tank body 306 is made of a resin which transmits light rays or a translucent resin, a user can check a remaining amount of ink in the ink tank 303 simply by looking at the visual recognition portion 350. The visual recognition portion 350 is provided with an upper limit instruction portion 351 and a lower limit instruction portion 352. The upper limit instruction portion 351 displays a liquid level height of a maximum capacity of ink which can be stored in the ink tank 303. On the other hand, the lower limit instruction portion 352 displays a liquid level height which encourages a user to inject ink into the ink tank 303.

Here, an operation of the ink tank 303 when supplying ink from the ink tank 303 to the recording head 310 will be described. When the recording head 310 consumes ink, that is, when the ink is ejected for image recording or the ink is ejected for cleaning or the like, the ink in the recording head 310 is insufficient. Then, ink is replenished from the ink tank 303 to the recording head 310 via an ink tube connecting the ink tank 303 and the recording head 310. As described above, it is the second ink chamber 401 which directly stores the ink supplied to the recording head 310. When the amount of ink in the second ink chamber 401 gradually decreases and the liquid level of the ink drops, an opening 371A of the atmospheric communication passage 371 on the second ink chamber 401 side, which is sealed by the ink, is opened. Then, air flows into the second ink chamber 401 from the atmospheric communication passage 371 which communicates the inside of the second ink chamber 401 with the outside of the ink tank 303. By the way, as described above, the first ink chamber 301 and the second ink chamber 401 are communicated with each other by the communication passage 220, and when the cap 304 is in the closed position, the valve body 207 opens the communication passage 220. However, since the inside of the first ink chamber 301 is sealed by the cap 304, the ink stored in the first ink chamber 301 is not supplied to the second ink chamber 401. However, when the liquid level of the ink stored in the second ink chamber 401 drops due to being supplied to the recording head 310, the air flowing into the second ink chamber 401 from the atmospheric communication passage 371 moves to the first ink chamber 301 via the communication passage 220. When the air in the second ink chamber 401 moves to the first ink chamber 301, so-called gas-liquid replacement occurs and the ink stored in the first ink chamber 301 flows into the second ink chamber 401 via the communication passage 220. When ink flows from the first ink chamber 301 to the second ink chamber 401, the liquid level of the ink in the second ink chamber 401 rises and the opening 371A of the atmospheric communication passage 371 on the second ink chamber 401 side is sealed with ink. At this point, the inflow of air from the atmospheric communication passage 371 into the second ink chamber 401 is stopped, so that the inflow of ink from the first ink chamber 301 to the second ink chamber 401 is also stopped.

As is clear from the above description, when ink is consumed by the recording head 310, air flows from the second ink chamber 401 to the first ink chamber 301. However, since the amount of air flowing from the second ink chamber 401 into the first ink chamber 301 at one time is not so large, the air becomes fine bubbles and flows into the first ink chamber 301.

By the way, when the amount of ink stored in the second ink chamber 401 is less than a predetermined amount, a situation occurs in which air is supplied to the recording head 310 from the ink outlet 360. When air is supplied from the ink tank to the recording head 310, the recording head 310 cannot eject ink, and thus a user may not be able to obtain a desired image. Therefore, the ink tank 303 is equipped with an electrode-type ink amount sensor (hereinafter referred to as a sensor) which detects the amount of ink in advance before the amount of stored ink decreases to a predetermined amount. The sensor detects whether the amount of ink in the ink chamber is equal to or more than a predetermined amount by directly inserting, for example, two electrode rods into the ink chamber and detecting a conduction state between the electrode rods.

In each ink tank 303, two electrode rods 331A and 331B are horizontally press-fitted into the first ink chamber 301 from an outer surface (side wall extending in the up-down direction) of the ink tank 303. The two electrode rods 331A and 331B are separated from each other by about 5 mm in the up-down direction. In a vicinity of these two electrode rods 331A and 331B, the connecting projection 208 of the first lever arm 206 and a connecting portion of the valve body 207 are arranged.

The valve body 207 includes a flat plate portion 207A and a communication passage guide portion 207B. The communication passage guide portion 207B moves up and down within the communication passage 220, and the flat plate portion 207A moves up and down while being in contact with the first guide rib 332 and the second guide rib 333, so that the valve body 207 can accurately open or close the communication passage 220 with the seal member 209.

Here, the communication passage 220 communicates the first ink chamber 301 and the second ink chamber 401 as described above. Further, the ink tank 303 is provided with the atmospheric communication passage 371 having the atmospheric communication port 370 at one end thereof and the opening 371A at the other end of the atmospheric communication passage 371 communicates only with the second ink chamber 401, and further the first ink chamber 301 does not directly communicate with the atmospheric communication passage 371.

When the valve body 207 moves up and down, two guide ribs 332 and 333 (see FIG. 7C) for guiding the movement of the valve body 207 are provided in the first ink chamber 301. The first guide rib 332 extends horizontally from a facing surface of the film 110 toward the inside of the first ink chamber 301. Further, the second guide rib 333 extends in the same direction as the first guide rib 332 from an outer peripheral wall of a lower penetration portion where the electrode rod 331B is press-fitted. The heights of the first guide rib 332 and the second guide rib 333 from the facing surface of the film 110 are substantially the same.

The valve body 207 includes the flat plate portion 207A and the communication passage guide portion 207B. In the valve body 207, the communication passage guide portion 207B moves up and down in the communication passage 220 and the flat plate portion 207A moves up and down while being in contact with the first guide rib 332 and the second guide rib 333 so that the valve body 207 can accurately open or close the communication passage 220 with the seal member 209.

As described above, when the ink is consumed by the recording head 310, the air (air bubbles) which has moved from the second ink chamber 401 to the first ink chamber 301 via the communication passage 220 rises almost vertically upward. Therefore, these air (air bubbles) pass through the vicinity of the electrode rods 331A and 331B of the sensor.

SUMMARY

One illustrative aspect of the present disclosure provides an ink tank configured to supply liquid to an apparatus having a liquid consumption device, the ink tank comprising: a first liquid storage chamber storing liquid to be supplied to the liquid consumption device; a second liquid storage chamber communicating with the first liquid storage chamber through a communication passage, the second liquid storage having a liquid outlet for supplying liquid to the liquid consumption device; a detector having at least two electrode rods in the first liquid storage chamber, the electrode rods being disposed above the communication passage; an injector having an opening supplying liquid to the first liquid storage chamber; an atmospheric communication passage communicating an outside of the ink tank with the second liquid storage chamber; a cap movable between an open position and a closed position with respect to the injector, the cap being configured to seal the first liquid storage chamber in a case the cap is in the closed position; a valve mechanism configured to open or close the communication passage by moving up and down with respect to the communication passage; a link mechanism configured to move the valve mechanism up and down; and a guide portion configured to guide the valve mechanism which is moved up and down by the link mechanism, wherein at least a part of the guide portion is provided in the valve mechanism.

According thereto, the valve body itself has a rib for regulating its own operation and an extension direction of the rib also has a vertical component. With this structure, the possibility that air (air bubbles) is blocked in the vicinity of the electrode rod can be reduced, so that false detection of the sensor can also be reduced.

BRIEF DESCRIPTION OF DRAWINGS

Illustrative embodiments of the present disclosure will be described in detail based on the following figures, wherein:

FIG. 1A illustrates a perspective view of an image recording apparatus 300 with an opening and closing cover 307 open and FIG. 1B illustrates a partially enlarged view of the image recording apparatus 300;

FIG. 5A illustrates a schematic view of a state in which (a valve member is sealed) the cap 304 is separated from the link mechanism and FIG. 5B illustrates a schematic view of a state in which (the valve member is opened) the link mechanism is operated by the cap 304 in a closed position;

FIG. 6A illustrates a schematic plan view of the valve body 207 and the seal member 209 of the related art and a schematic cross-sectional view cut along the VIA-VIA line and FIG. 6B illustrates a schematic side view of the valve body 207 and the seal member 209 of the related art and a schematic cross-sectional view cut along the VIB-VIB line;

FIG. 7A illustrates a state in which the valve body 207 and the seal member 209 of the related art illustrated in FIG. 6A close the communication passage 220, FIG. 7B illustrates a state in which the valve body 207 and the seal member 209 of the related art illustrated in FIG. 6A open the communication passage 220, and FIG. 7C illustrates a schematic view showing an arrangement of various members around the communication passage 220;

FIG. 8A illustrates a schematic plan view of the valve body 407 and the seal member 409 and a schematic cross-sectional view cut along the line VIIIA-VIIIA and FIG. 8B illustrates a schematic plan view of the valve body 407 and the seal member 409 and a schematic cross-sectional view cut along the line VIIIB-VIIIB;

FIGS. 9A to 9C are schematic views illustrating an operation of the valve body 407 and the seal member 409 of the illustrative embodiment opening or closing the communication passage 220 and a schematic view illustrating an arrangement of various members around the communication passage 220, in which FIG. 9A is a schematic partial view of a state in which the valve body 407 and the seal member 409 illustrated in FIG. 8A close the communication passage 220 when viewed from a left side surface of an ink tank, FIG. 9B illustrates a schematic partial view of a state in which the valve body 407 and the seal member 409 illustrated in FIG. 8A open the communication passage 220 when viewed from the left side surface of the ink tank, and FIG. 9C is a schematic view illustrating an arrangement of various members around the communication passage 220.

DETAILED DESCRIPTION

In the above-explained related art, since the first guide rib 332 and the second guide rib 333 are provided in the vicinity of the two electrode rods 331A and 331B, there is a risk that the raised air (air bubbles) will be blocked by these first guide rib 332 and second guide rib 333. When the electrode rods 331A and 331B are covered with a large amount of air (air bubbles), the sensor may make false detection.

Therefore, illustrative aspects of the disclosure is made to solve the problem described above.

Hereinafter, an illustrative embodiment of the disclosure will be described. It goes without saying that the illustrative embodiment described below are merely an example of the disclosure and the illustrative embodiment of the disclosure can be appropriately changed without changing the scope of the disclosure.

Figures 8A, 8B:
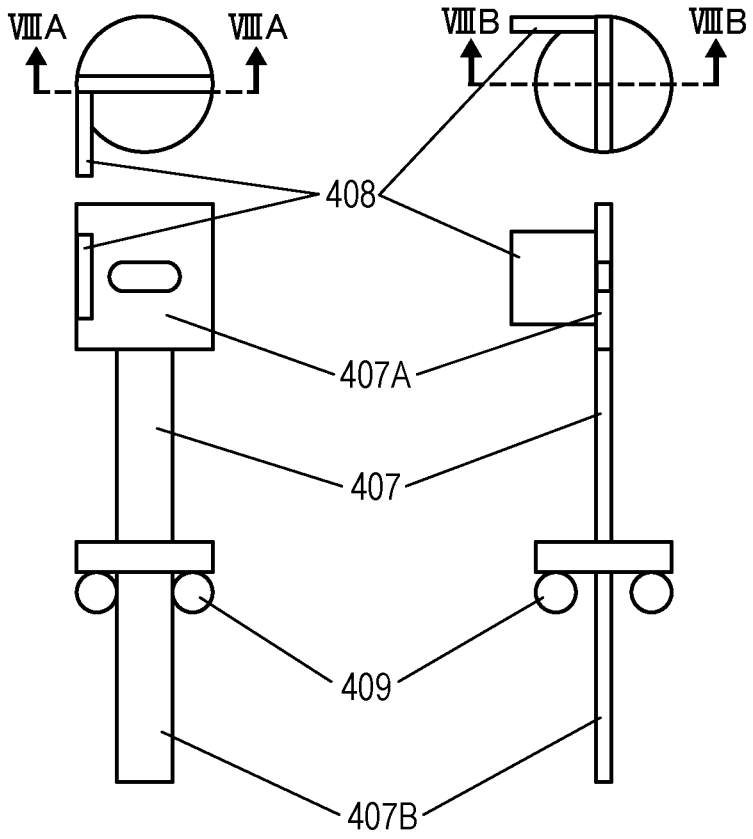
FIGS. 8A and 8B are views illustrating a schematic structure of a valve body 407 and a seal member 409 of an illustrative embodiment, where

FIGS. 8A and 8B are views illustrating a schematic structure of a valve body 407 and a seal member 409 of an illustrative embodiment, where FIG. 8A illustrates a schematic plan view of the valve body 407 and the seal member 409 and a schematic cross-sectional view cut along the line VIIIA-VIIIA and FIG. 8B illustrates a schematic plan view of the valve body 407 and the seal member 409 and a schematic cross-sectional view cut along the line VIIIB-VIIIB.

Figures 9A, 9B, 9C:
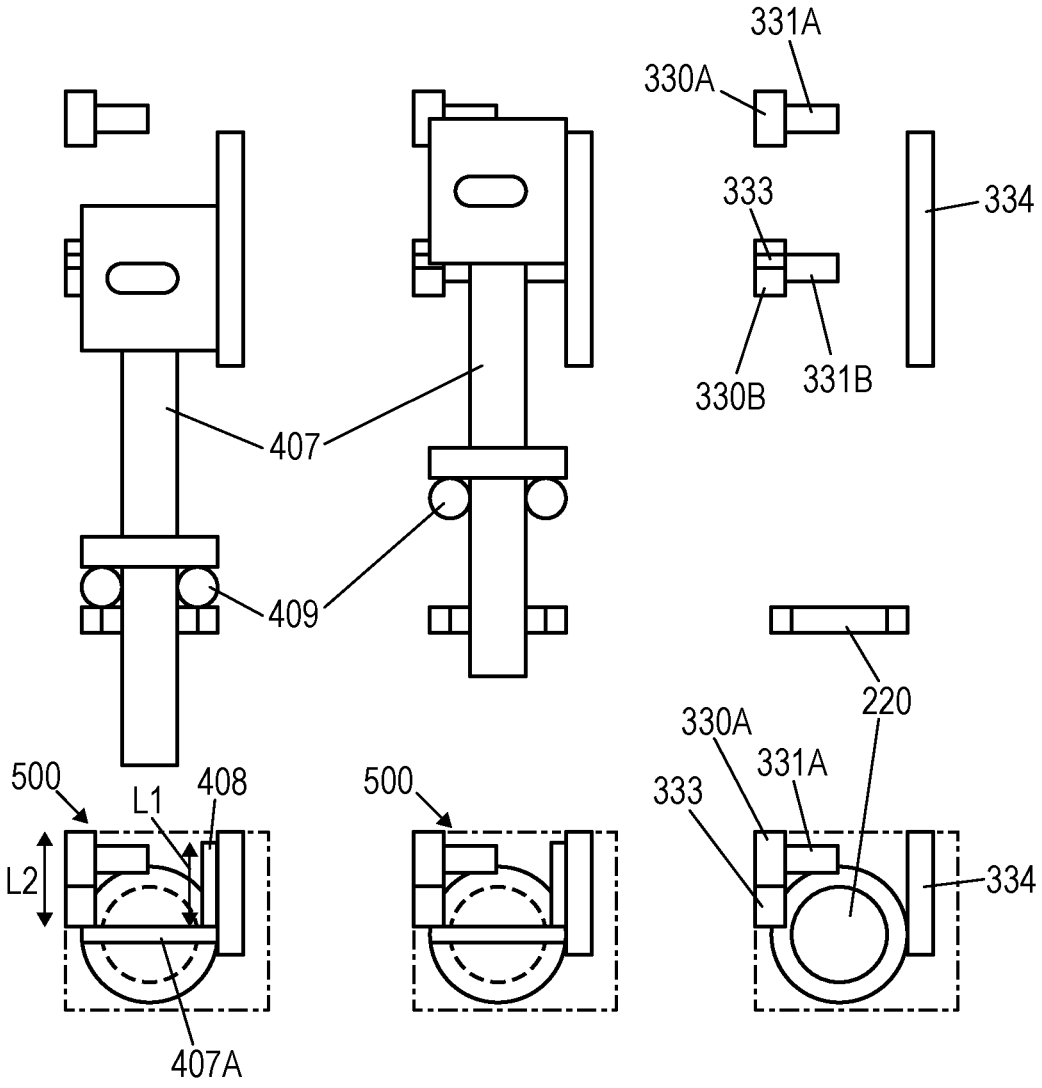

FIGS. 9A to 9C are schematic views illustrating an operation of the valve body 407 and the seal member 409 of the illustrative embodiment opening or closing an communication passage 220 and a schematic view illustrating an arrangement of various members around the communication passage 220, where FIG. 9A is a schematic partial view of a state in which the valve body 407 and the seal member 409 illustrated in FIG. 8A close the communication passage 220 when viewed from a left side surface of an ink tank, FIG. 9B illustrates a schematic partial view of a state in which the valve body 407 and the seal member 409 illustrated in FIG. 8A open the communication passage 220 when viewed from the left side surface of the ink tank, and FIG. 9C is a schematic view illustrating an arrangement of various members around the communication passage 220.

Figure 10:
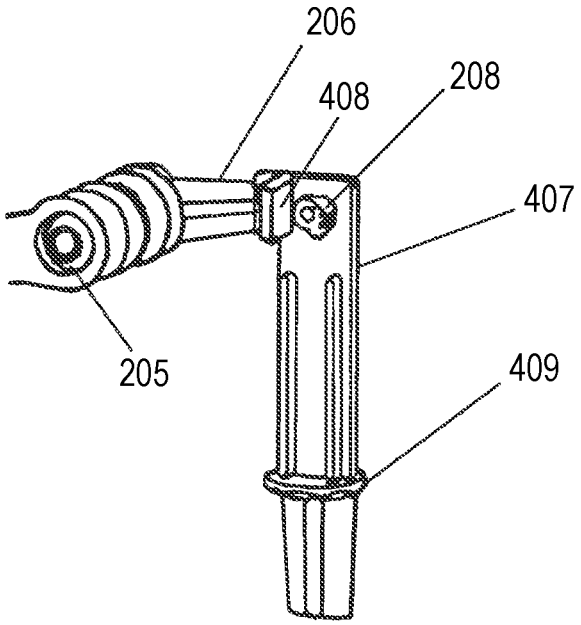
FIG. 10 illustrates a schematic perspective view of the valve body 407 including a guide member 408 of the illustrative embodiment.

FIG. 10 illustrates a schematic perspective view of the valve body 407 including a guide member 408 of the illustrative embodiment.

First, the structure of the valve body 407 of the illustrative embodiment will be described with reference to FIGS. 8A and 8B. The valve body 407 includes a flat plate portion 407A, a guide portion 407B, and the guide member 408 and has substantially the same structure as a valve body 207 of the related art except for the presence of the guide member 408.

The guide member 408 extends from the flat plate portion 407A of the valve body 407 in a direction orthogonal to the flat plate portion 407A and in a vertical direction. The guide member 408 may be integrally molded with the valve body 407, or a member separate from the valve body 407 may be fixed to the flat plate portion 407A.

Next, an operation of the valve body 407 and the seal member 409 of the illustrative embodiment opening or closing the communication passage 220 will be described with reference to FIGS. 9A to 9C.

An ink tank 500 of the example has the same structure as an ink tank 303 of the related art except for a first guide rib 332. That is, the ink tank 500 of the example is not provided with the first guide rib 332. Therefore, regarding the ink tank 500 of the example, only a part having a structure different from that of the ink tank 303 of the related art will be described.

Also in the ink tank 500 of the illustrative embodiment, similar to the ink tank 303 of the related art, two electrode rods 331A and 331B are horizontally press-fitted into a first ink chamber 301 from an outer surface (side wall extending in an up-down direction) of the ink tank 500. The two electrode rods 331A and 331B are separated from each other by about 5 mm in the up-down direction. In a vicinity of the two electrode rods 331A and 331B, a connecting projection 208 of a first lever arm 206 and a connecting portion of the valve body 407 are arranged. The second guide rib 333 extends in the same direction as the first guide rib 332 from an outer peripheral wall 330B (one example of a covering member) of a lower penetration portion where the electrode rod 331B is press-fitted. Incidentally, the second guide rib 333 may extend from an outer peripheral wall 330A (one example of a covering member) of an upper penetration portion where the electrode rod 331A is press-fitted. The first guide rib 332 is supported by a first support rib 334 at a front side thereof. The first support rib 334 protrudes from an inner surface of the first ink chamber 301 and extends in a vertical direction to partially partition the first ink chamber 301.

As described above, when the valve body 407 moves up and down, only a second guide rib 333 is provided in the first ink chamber 301. The first guide rib 332 of the related art is not provided. As a result, if the valve body 407 hits only the second guide rib 333 when moving up and down, the operation of the valve body 407 becomes unstable. Therefore, the valve body 407 of the present illustrative embodiment is provided with the guide member 408 for stabilizing a moving operation during vertical movement in the flat plate portion 407A. As is clear from FIGS. 9A and 9B, a length L1 of the guide member 408 is substantially the same as a distance L2 between the flat plate portion 407A and a wall of the ink tank 500. That is, the length L1 of the guide member 408 is substantially equal to a sum of a length in an extension direction of the second guide rib 333 and a thickness of the outer peripheral wall 330B from the wall of the ink tank 500. Due to the presence of the guide member 408, the valve body 407 during vertical movement can move up and down stably in cooperation with the second guide rib 333. The first support rib 334 may be configured to guide the flat plate portion 407A and/or the guide member 408.

Figure 1B:
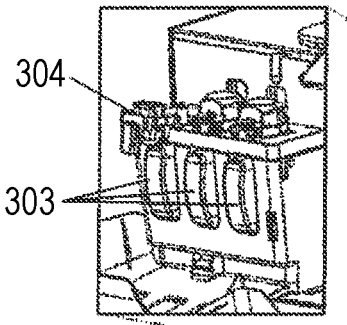
FIGS. 1A and 1B are perspective views of an image recording apparatus, where
Figure 1A:
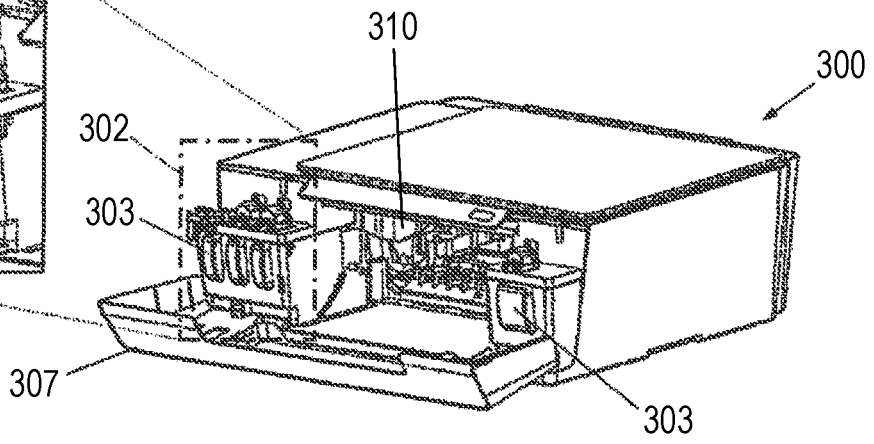
Figure 1A:
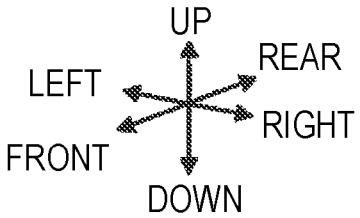
Figure 2:
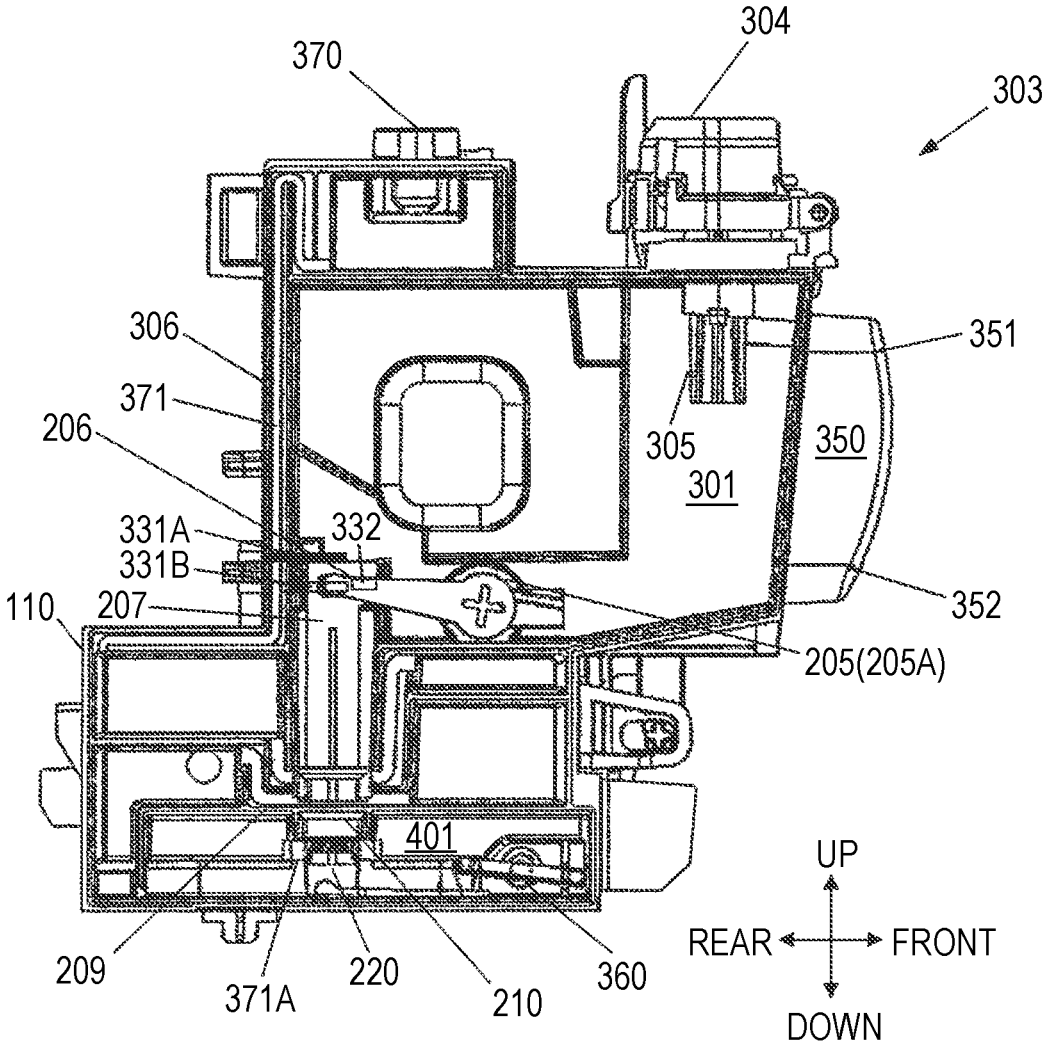
FIG. 2 is a left side view of an ink tank 303 of the related art with a cap 304 in a closed position.
Figure 3:
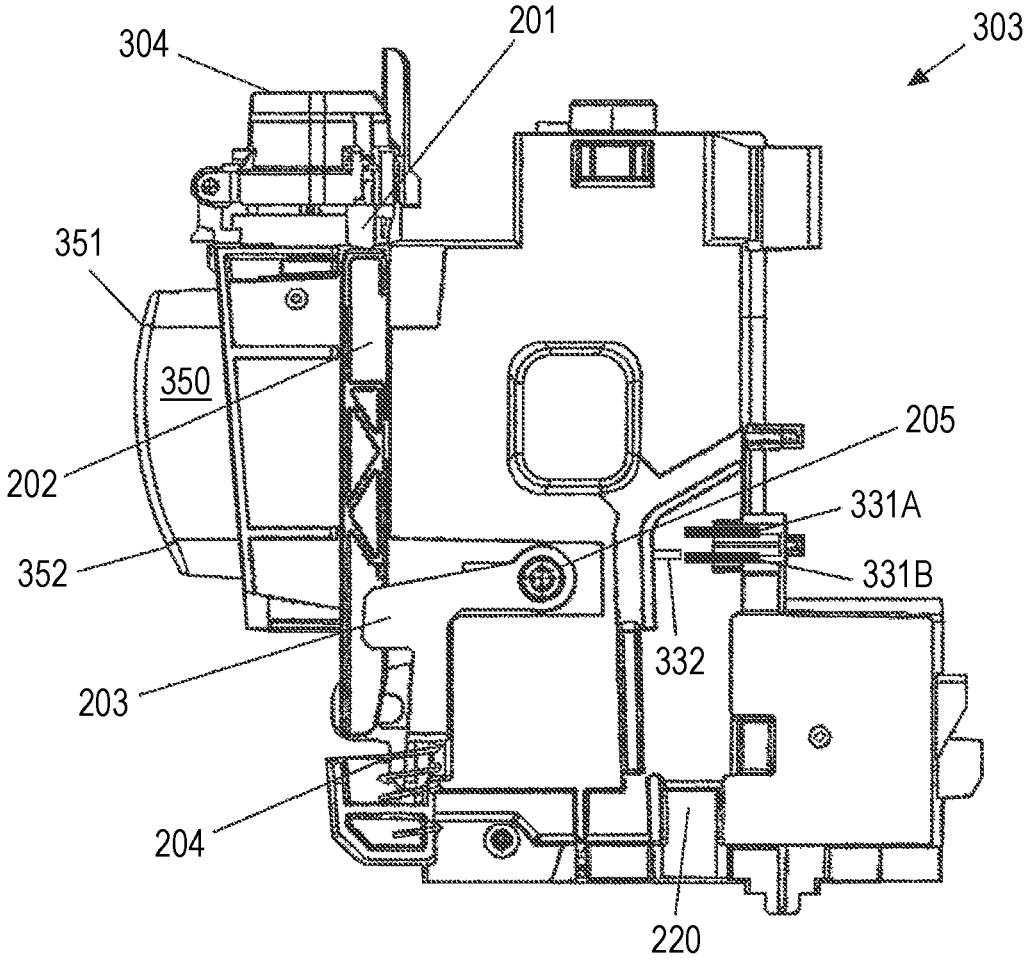
FIG. 3 is a right side view of the ink tank 303 of the related art with the cap 304 in the closed position. However, positions of two electrode rods 331A and 331B and a first guide rib 332 of a sensor are emphasized so that an arrangement thereof, which cannot be seen from a right side surface, can be understood.
Figure 4:
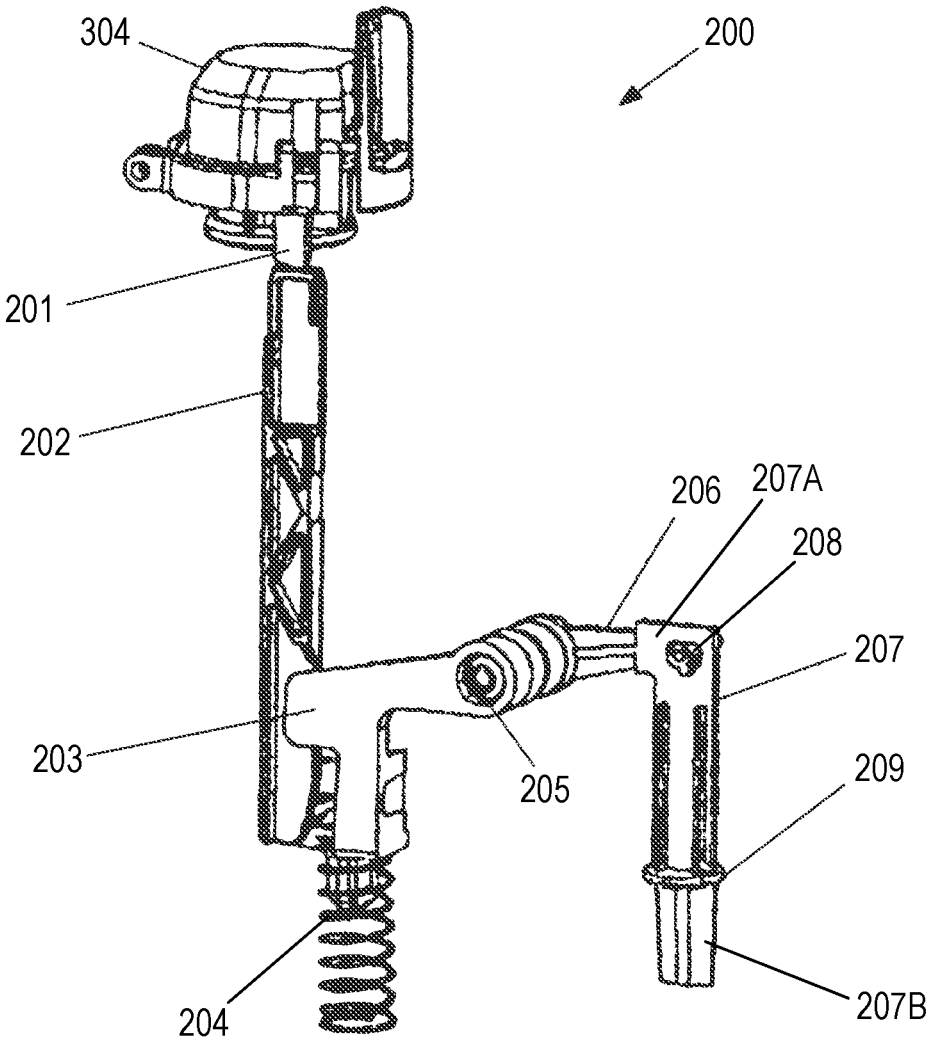
FIG. 4 is a perspective view illustrating only a link mechanism 200 used in the ink tank 303 of the related art.
Figure 5A:
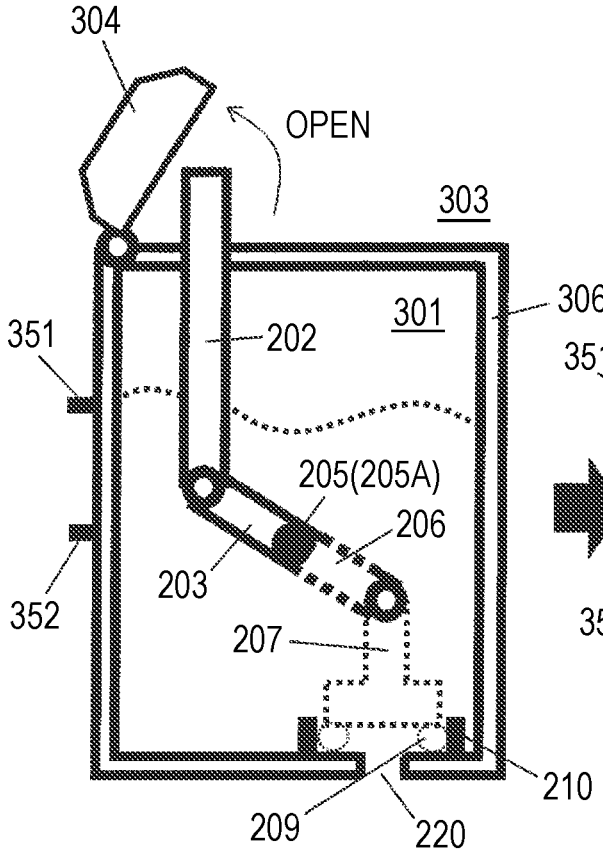
FIGS. 5A and 5B are schematic views briefly illustrating an operation of the cap 304 of the related art and the link mechanism, where
Figure 5B:
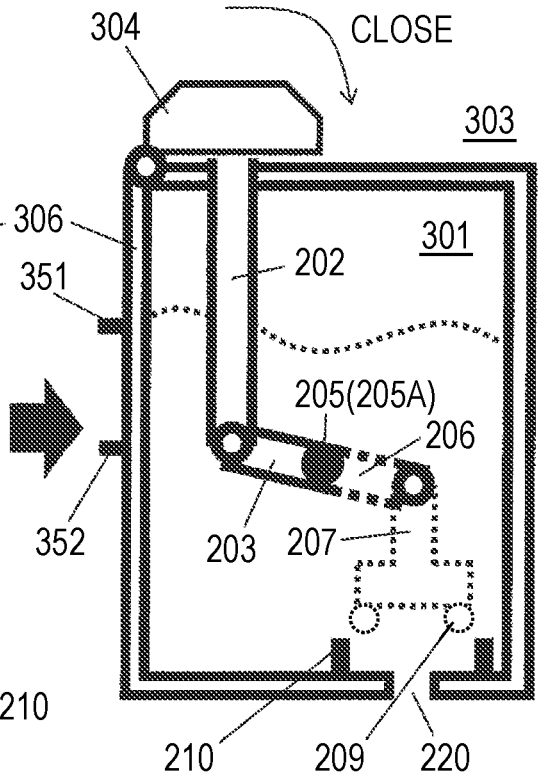
Figure 6A:
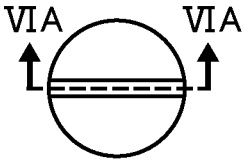
FIGS. 6A and 6B are views illustrating a schematic structure of a valve body 207 and a seal member 209 of the related art, where
Figure 6B:
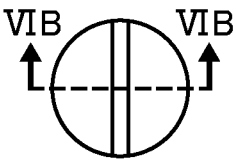
Figure 6B:
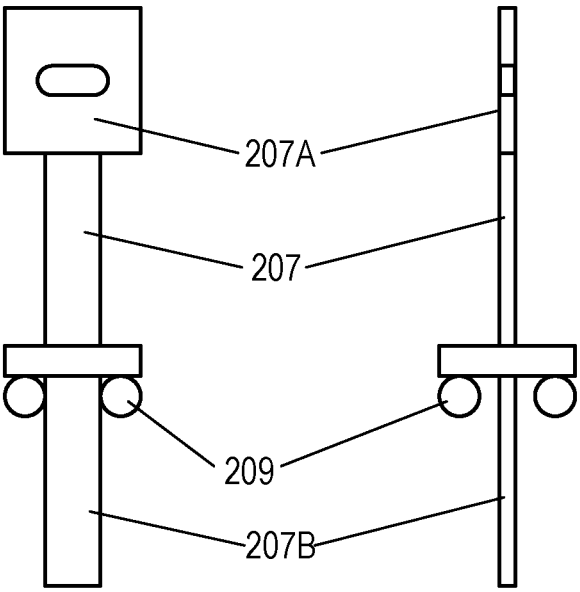
Figure 7A:
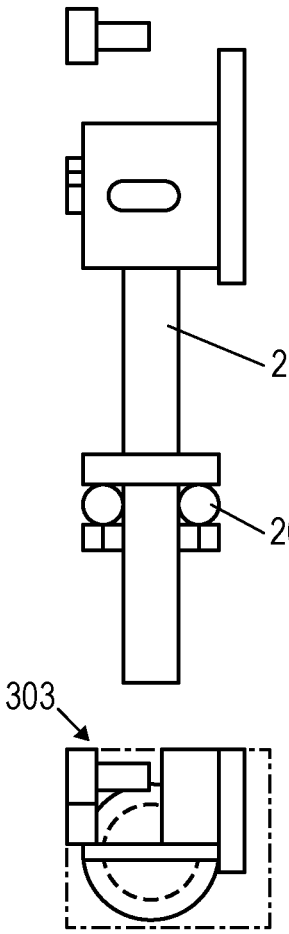
FIGS. 7A to 7C are schematic views illustrating an operation of the valve main body 207 and the seal member 209 of the related art opening or closing a communication passage 220 and a schematic view illustrating an arrangement of various members around the communication passage 220, where
Figure 7B:
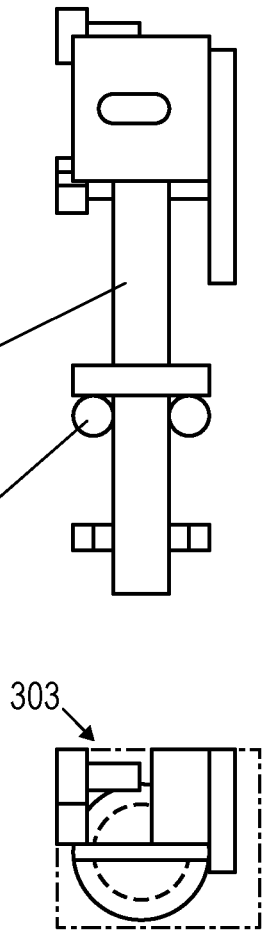
Figure 7C:
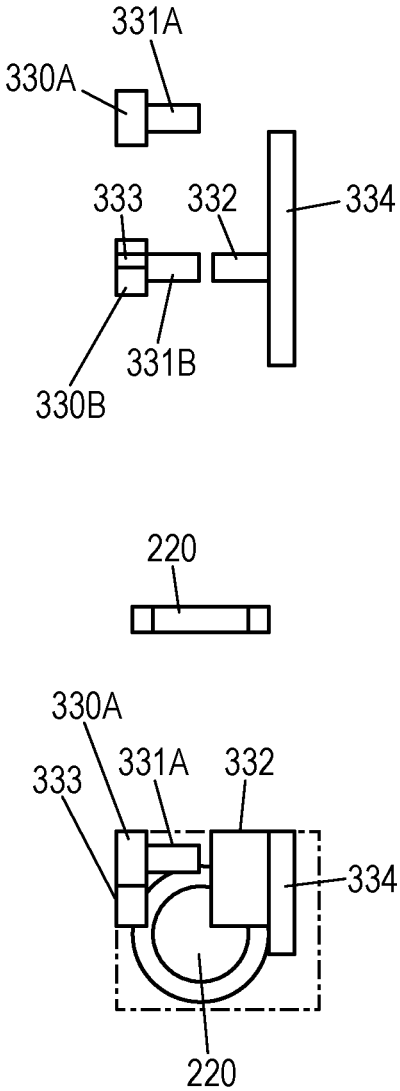

Further, as is clear from FIG. 9C, there are no members around the electrode rods 331A and 331B which hinder progress of air (air bubbles) like the first guide rib 332 of the related art. As illustrated in a front view and a plan view of FIG. 7C, since the first guide rib 332 of the related art is provided vertically above so as to cover a part of the communication passage 22 and is arranged at a position extremely close to the electrode rod 331B, air (air bubbles) rising almost vertically upward from the communication passage 220 is retained. Therefore, there is a possibility that false detection of a sensor may occur due to the air (air bubbles) staying in the vicinity of the electrode rods 331A and 331B.

However, in the ink tank of the illustrative embodiment, a member such as the first guide rib 332 is deleted and a guide member 408 is provided on the valve body 407 side. As is clear from FIG. 9C, the guide member 408 is not arranged vertically above the communication passage 220 in a plan view. Therefore, as with the first guide rib 332 of the related art, the vertical movement of the valve body 407 is stable and the retention of air (air bubbles) in the vicinity of the sensor can be reduced. As a result, false detection of the sensor can be reduced.

Modification Example

In the illustrative embodiment described above and shown in FIGS. 8A to 10, the guide member 408 extends from the flat plate portion 407A of the valve body 407 in the direction orthogonal to the flat plate portion 407A and in the vertical direction. However, for the purpose of not blocking the rising air (air bubbles), the guide member 408 may extend in a direction intersecting the flat plate portion 407A and in a direction having a vertical component.

Further, the vertical component may have an angle more than a horizontal component.

In addition, although the first guide rib 332 is eliminated and the guide member 408 is provided. However, the first guide rib 332 may be shortened (lower height) to have a larger amount of air (air bubbles) passing through than the ink tank of the related art, and then the vertical movement of the valve body 407 may be stabilized in cooperation with the guide member 408.

In addition, when a diameter of a flange portion which supports the seal member 409 is made larger than the current diameter, the possibility of movement of the seal member 409 will be reduced, and further, by storing air (bubbles) here, the movement of air (bubbles) to the electrode rod can be reduced.

What is claimed is:

1. An ink tank configured to supply liquid to an apparatus having a liquid consumption device, the ink tank comprising:

a first liquid storage chamber storing liquid to be supplied to the liquid consumption device;

a second liquid storage chamber communicating with the first liquid storage chamber through a communication passage, the second liquid storage having a liquid outlet for supplying liquid to the liquid consumption device;

a detector having at least two electrode rods in the first liquid storage chamber, the electrode rods being disposed above the communication passage;

an injector having an opening supplying liquid to the first liquid storage chamber;

an atmospheric communication passage communicating an outside of the ink tank with the second liquid storage chamber;

a cap movable between an open position and a closed position with respect to the injector, the cap being configured to seal the first liquid storage chamber in a case the cap is in the closed position;

a valve mechanism having a flat plate portion and configured to open or close the communication passage by moving up and down with respect to the communication passage;

a link mechanism configured to move the valve mechanism up and down;

a guide portion configured to guide the valve mechanism which is moved up and down by the link mechanism, the guide portion extending from the flat plate portion of the valve mechanism in a direction orthogonal to the flat plate portion and in a vertical direction; and a rib protruding from an inner surface of the first ink chamber and configured to guide the guide portion, the rib extending in the extending direction of the guide portion, wherein at least a part of the guide portion is provided in the valve mechanism.

2. The ink tank according to claim 1, wherein a length of the guide portion provided in the valve mechanism in an extending direction is substantially equal to a length between a part of the valve mechanism provided with the guide mechanism and a wall of the ink tank.

3. The ink tank according to claim 1, wherein an extension direction of the guide portion provided in the valve mechanism has a horizontal component.

4. The ink tank according to claim 1, wherein the guide portion comprises:

a first guide portion provided in the valve mechanism; and a second guide portion not provided in the valve mechanism, the second guide portion being provided in the first liquid storage chamber and is integrally formed with a covering member of the electrode rod.

5. The ink tank according to claim 4, wherein a length of the first guide portion in the extension direction is substantially equal to a sum of a length in an extension direction of the second guide portion and a thickness of the covering member from the wall of the ink tank.

6. An image recording apparatus, comprising:

a liquid consumption device; and the ink tank according to claim 1 configured to supply liquid to the liquid consumption device.

7. The ink tank according to claim 1, wherein a plane of the rib extending in the direction orthogonal to the flat plate portion and in the vertical direction faces a plane of the guide portion.

* * * * *